US007287337B2

(12) United States Patent
Dimitroff

(10) Patent No.: US 7,287,337 B2
(45) Date of Patent: Oct. 30, 2007

(54) PITCH SENSING IN DRILLING MACHINES

(75) Inventor: Ted Dimitroff, Columbia, MO (US)

(73) Assignee: Theodore Roy Dimitroff, Columbia, MO (US)

( * ) Notice: Subject to any disclaimer, the term of this patent is extended or adjusted under 35 U.S.C. 154(b) by 0 days.

(21) Appl. No.: 10/528,047

(22) PCT Filed: Sep. 19, 2003

(86) PCT No.: PCT/EP03/10474

§ 371 (c)(1),
(2), (4) Date: Jan. 6, 2006

(87) PCT Pub. No.: WO2004/027214

PCT Pub. Date: Apr. 1, 2004

(65) Prior Publication Data

US 2006/0137196 A1 Jun. 29, 2006

(30) Foreign Application Priority Data

Sep. 19, 2002 (GB) ..... 0221717.2

(51) Int. Cl.
*E21B 47/022* (2006.01)

(52) U.S. Cl. ..... 33/308; 175/45

(58) Field of Classification Search ..... 33/308, 33/333, 334, 370, 371, 372, 373, 304, 309, 33/310, 311, 313; 175/45, 40
See application file for complete search history.

(56) References Cited

U.S. PATENT DOCUMENTS 4,164,871 A 8/1979 Cole et al.
4,510,696 A * 4/1985 Roesler ..... 33/304
5,014,795 A 5/1991 Gibson
5,314,030 A * 5/1994 Peterson et al. ..... 175/26
5,320,180 A 6/1994 Ruley et al.
5,646,611 A * 7/1997 Dailey et al. ..... 340/853.6
5,795,991 A 8/1998 Hesse et al.
5,806,195 A * 9/1998 Uttecht et al. ..... 33/304
5,850,624 A 12/1998 Gard et al.

(Continued)

FOREIGN PATENT DOCUMENTS

EP 0 520 733 12/1992

(Continued)

*Primary Examiner*—Christopher W Fulton
(74) *Attorney, Agent, or Firm*—Oblon, Spivak, McClelland, Maier & Neustadt, P.C.

(57) ABSTRACT

A pitch sensor tool for a stem boring or drilling machine, for example a sub-surface directional drilling machine having a stem and a drilling head. The pitch sensor tool includes a generally cylindrical housing adapted to be mechanically coupled to the stem and to the drilling head, and a pitch sensing device disposed in or on the housing and adapted to transmit a reading of the second pitch of the pitch sensor tool. In one example, the pitch sensing device is housed in a compartment in the pitch sensor tool. A boring or drilling tool incorporates the pitch sensing tool and a drilling head, and a stem boring or drill machine incorporates the pitch sensing tool. By separating of the pitching sensing device from the rotating parts (i.e., drilling head or guide head) the pitch reading can be measured accurately and during a drilling procedure, as well as after it.

10 Claims, 1 Drawing Sheet

U.S. PATENT DOCUMENTS

| | | | | |
|---|---|---|---|---|
| 5,964,294 | A | 10/1999 | Edwards et al. | |
| 6,179,066 | B1 | 1/2001 | Nasr et al. | |
| 6,179,067 | B1 * | 1/2001 | Brooks | 175/45 |
| 6,871,410 | B1 * | 3/2005 | Le Jeune | 33/313 |
| 6,918,186 | B2 * | 7/2005 | Ash et al. | 33/313 |
| 7,028,409 | B2 * | 4/2006 | Engebretson et al. | 33/304 |
| 7,080,460 | B2 * | 7/2006 | Illfelder | 33/313 |

FOREIGN PATENT DOCUMENTS

| | | |
|---|---|---|
| EP | 0 806 542 A2 | 11/1997 |

* cited by examiner

PITCH SENSING IN DRILLING MACHINES

The present invention relates to sub-surface drilling or boring machine technologies, and more particularly to the sensing of pitch (or percent of grade) of the boring tool in such machines.

Directional boring machines are well known, and these can be used for drilling bores in a horizontal or non-horizontal direction under the control of the machine, often referred to as stem drilling machines. For example, U.S. Pat. No. 5,288,173 discloses a method for the directional control of an earth boring device, in which the device is driven forward either by the impacts of an impact piston or by a forward pressure exerted on the device through a rod. Directional control of the device is achieved by arranging a plurality of pressure fluid ejecting nozzles on the head of the device symmetrically with respect to its longitudinal axis. By individually controlling the pressure and/or the amount of pressure fluid supplied to each nozzle, the device is kept aligned with the direction of its forward drive path.

DE-A-4432710 discloses an underground horizontal boring tool with directional control. The arrangement consists of a string of interconnected guide tubes at the front end of which a boring head with sloping front face is mounted. The string of tubes is mounted in an outer tube which has a ring shaped boring head at its front end. The head with sloping front face can be pushed out off the outer tube and can be rotated to alter the direction of boring. Axial impacts can be imparted on the inner head e.g. when it meets a hard obstruction so that the head can bore through it. The front of the boring arrangement carries a magnet so that its position can be determined from above ground.

Additional complexity is involved when it is desired to drill bores at a certain pitch to the horizontal. Typically, it is desired to drill earth bores with a pitch (or percent of grade or slope; hereafter "pitch") with respect to the horizontal that is constant or substantially constant along its length. This is the case, for example, with sanitary sewer lines that need a constant pitch so that fluid flows under gravity along the line. The problem of providing such constant pitch in these bores involves the difficulty of detecting the current pitch at any given instant during the boring process.

Attempts to overcome this problem have involved placing a pitch sensor on the drilling tool or head at the end of the machine stem. The main and serious problem with such machines is that it is not possible to check the pitch while the head is rotating: they require the operator to stop the machine and check the pitch. A further problem is that while some existing tools may include sensors that provide a good pitch reading, once they are installed the pitch reading changes.

The present invention provides a pitch sensor tool for a stem boring or drilling machine having a stem and a drilling head, comprising: a generally cylindrical housing adapted to be coupled to said stem and to said drilling head, a pitch sensing device, the pitch sensing device being disposed in or on the housing and being adapted to transmit a reading of the sensed pitch of the pitch sensor tool.

The pitch sensing device may be fixedly mounted in or on the pitch sensing tool and separated therefrom by a shock absorbing material. The pitch sensing device is for example mounted within a compartment within the pitch sensing tool.

Alternatively, the pitch sensing device is mounted for movement inside and relative to the pitch sensor tool about the axis of rotation of the pitch sensor tool, preferably whereby, in use, the pitch sensing device remains substantially stationary. The pitch sensing device may be mounted on wheels within a cylindrical compartment inside the pitch sensor tool, whereby the pitch sensing device runs on said wheels over the cylindrical internal surface of the compartment.

The pitch sensing device may alternatively be mounted within and coupled to a cylindrical compartment inside the pitch sensor tool via bearings, whereby the pitch sensing device is free to rotate with respect to the pitch sensor tool. The pitch sensing device is for example mounted on an axle, the axle being mounted at each end thereof in bearings fixedly attached in said cylindrical compartment. Preferably, the pitch sensing device has weights attached at, on or near the base thereof, thereby facilitating said pitch sensing device remaining stationary while said pitch sensor tool, in use, rotates.

Preferably, the pitch sensing device is mounted in or on the pitch sensing tool at perfect zero percent prior to use, whereby when the pitch sensing tool is in an actual horizontal position, said reading of the sensed pitch transmitted by the pitch sensing device is zero.

The pitch sensor tool preferably further includes a female engagement portion for engagement, in use, by a male engagement portion of the stem. The pitch sensor tool preferably further includes a male engagement portion for engagement, in use, by a female engagement portion of the drilling head.

The pitch sensor tool of any of the preceding claims, further including a battery compartment housing a battery for powering the pitch sensing device.

The present invention further provides a boring or drilling tool comprising a pitch sensing tool and a drilling head, the drilling head including a drill bit.

Preferably, the drilling head includes a housing having a clock sensor mounted therein, the clock sensor being adapted to transmit a reading indicative of the sensed angular position of the drill bit.

The present invention further provides a stem boring or drilling machine comprising a stem, a drive section for applying rotational energy to the stem, a pitch sensor tool and a drilling head, the drilling head including a drill bit, wherein the pitch sensor tool is disposed between the stem and the drilling head and mechanically coupled to each.

In the boring or drilling machine, the stem may be a dual stem comprising inner and outer sections, the pitch sensor being mounted on a non-rotating outer section of the pitch sensor tool. Alternatively, the stem is a single stem, and the pitch sensing device is fixedly mounted on the pitch sensor tool and rotates, in use, therewith.

The aforementioned arrangements can suitably be used in directional and non-directional boring systems. An advantage of the invention is that allows monitoring of the pitch while the drilling or guide head is rotating during a drilling or boring procedure. Another advantage is that the tool facilitates a more accurate reading being taken away from the drilling or guide head. The invention advantageously avoids the occurrence of changed readings post-install of the tool.

Embodiments of the invention will now be described, by way of example, with reference to the accompanying drawings, in which.

Figure 1:
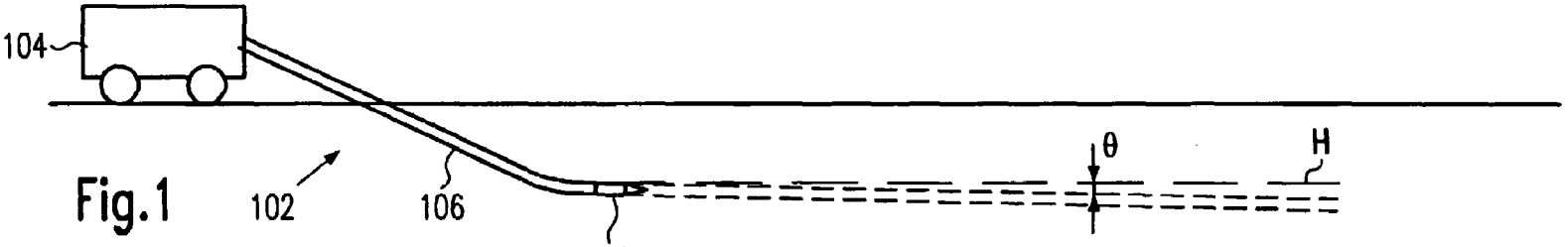
FIG. 1 is a schematic sectional view of a stem drilling machine engaged in a drilling procedure.

Turning to FIG. 1, this is a schematic sectional view of a stem drilling machine engaged in a drilling procedure. As is well known, the drilling machine 102 comprises a vehicle 104 on the surface housing a motor (not shown) for applying rotational energy to a stem 106, at the end of which is a drilling or boring tool 108.

In some operations, the intended path of the boring tool 108 is, as shown (dotted lines), at a shallow constant pitch at a small angle θ to the horizontal H. In many applications, it is desirable to use standard boring equipment to install new pipelines, such as gravity sewer lines, precisely on pitch and on line every time. With some traditional boring installation methods, the job has to be finished before it is known whether the target pitch and line have been achieved or not. Some electronic tracking equipment for such boring is said to be accurate to ±2% of the depth indicated, which for a depth of 20 feet, means that the bore stem may actually be 7 inches higher or lower than indicated. Critical path installations, especially gravity flow sewers, often require accuracy to within ±0.5%, or less.

The arrangements according to the invention are designed to provide accurate indication of pitch during the boring process.

Figure 2:
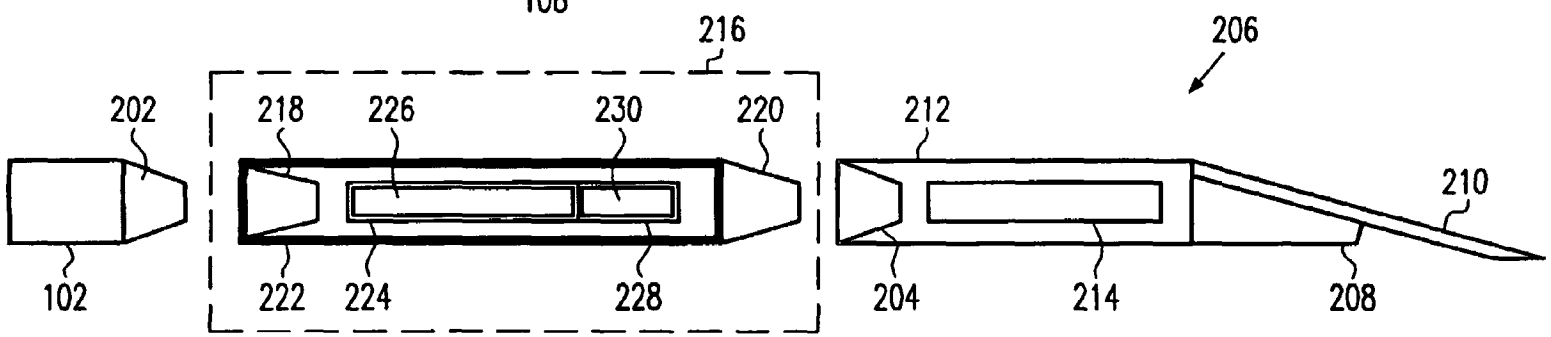
FIG. 2 shows an exploded cross-sectional view of the components connected to the drill stem in accordance with one aspect of the present invention.

FIG. 2 shows an exploded cross-sectional view of the components connected to the drill stem in accordance with one aspect of the present invention. As is conventional, the end of the stem 102 includes a male portion 202 for mechanical engagement with a tool, as described hereinafter. This end would, in conventional arrangements, engage a corresponding female portion 204 of the drilling or boring tool (also referred to as guide head) generally designated 206 to transmit rotational energy thereto. As is known, the drilling tool 206 includes a nose cone 208 holding the drill bit 210. The drilling tool 206 includes a housing (also known as beacon housing) 212 having an internal compartment 214 for sensor/measurement electronics (not shown). This compartment 214 houses the clock sensor (not shown) that provides an indication of the drill bit angular position: in FIG. 2, the drill bit is illustrated in the 6 o'clock position. In use the clock position must be known by the operator to be in the correct position when he pushes the tool forward to steer the tool/stem. Traditionally, the compartment 214 also houses a pitch sensing device (not shown) for giving an indication of pitch (or percent of grade) when the machine has been stopped.

However, in accordance with the invention, a separate pitch sensor tool, generally designated 216 is provided: this is mechanically connected (using conventional techniques such as screw threads) for transmission of drive via female portion 218 and male portion 220 from stem 102 and to drilling tool 206, respectively.

In the case where the stem 104 is a duel stem having and inner rotating stem (not shown) driving the tool 206 and an outer non-rotating stem (not shown), an outer hollow cylindrical member 222 of the pitch sensor tool 216 has a compartment 224 housing the pitch sensing device 226. The pitch sensing device can be accessed by a side door (not shown) in the pitch sensor tool 216, or by an opening at the rear of the pitch sensor tool 216 where the stem 102 screws into the pitch sensor tool 216. The cylindrical member 222 may also include a battery compartment 228 housing a battery 230 providing power to the pitch sensing device 226, although power may be provided from elsewhere.

The pitch sensing device 226 is suitably an industry standard device for sensing pitch or percent of grade and transmitting a reading to a receiving unit, for example on the vehicle 104 in FIG. 1. This pitch sensing device 226 is typically able to measure pitch in steps of tenths of a percent (0.1%). The pitch sensing device 226 incorporates electronics for transmitting signals via electromagnetic radiation (e.g. RF); and the pitch sensor tool 216, although mainly of high strength metal (e.g. steel) construction, has windows in the metal, sealed with epoxy, that permit transmission of the signals from the pitch sensing device 226.

The pitch sensing device 226 is in this embodiment fixed solid into the pitch sensor tool 216 (in compartment 224), by a suitable shock absorbing material, at the time of manufacture of the tool 216. This is done with the pitch sensor tool 216 effectively calibrated for perfect zero percent: i.e. the manufacture of the tool is effected such that, when the tool is in an actual known horizontal, the reading given by the pitch sensing device is zero.

Figure 3A:
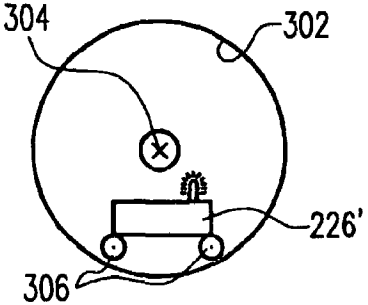
FIGS. 3(*a*), (*b*) and (*c*) are cross-sectional views of the internal compartment of the pitch sensor tool of FIG. 2.
Figure 3B:
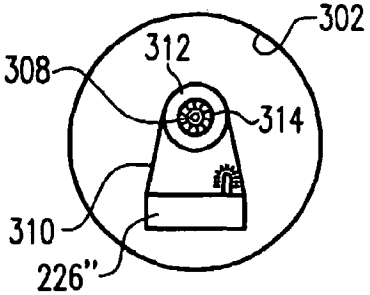
Figure 3C:
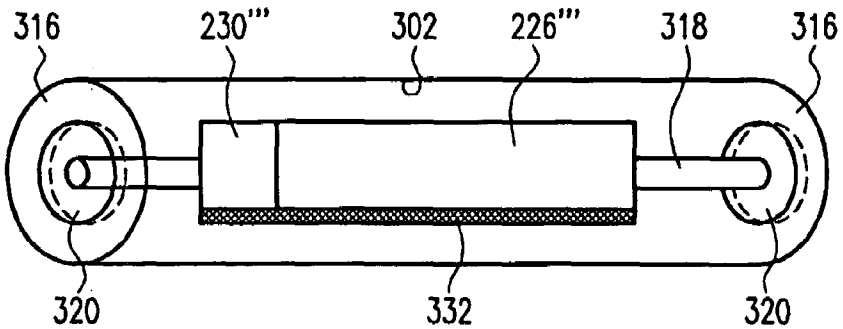

FIGS. 3(*a*) and (*b*) are cross-sectional views of the internal compartment of the pitch sensor tool 216 of FIG. 2 in an alternative embodiment. This embodiment is the same as the previous embodiment, except as described below. Here the stem 102 has a single stem, rather than duel stem, and the pitch sensor tool in this case includes an internal compartment of circular cross-section, so that the compartment has cylindrical internal wall 302. The axis of rotation is 304 (into the paper). In the embodiment of FIG. 3(*a*), the pitch sensing device 226' is mounted on wheels 306 which permit the pitch sensing device 226 to run on the internal surface 302. In this way, the pitch sensing device 226' can effectively rotate at the same speed as the pitch sensor tool 216, but in the opposite sense, and thereby remain stationary, or substantially stationary, with respect to the ground. This arrangement permits the pitch sensing device 226' to give signals accurately indicating the pitch, and unaffected by rotational movement.

FIG. 3(*b*) illustrates an alternative embodiment (this is the same as the previous embodiment, except as described hereinafter), in which an axel 308, coincident with the axis of rotation of the tool 216, is mounted inside the walls 302 of the compartment. In this case, the pitch sensing device 226" is suspended at each of its two ends (only one of which is shown) via wires 310 on a ring 312 mounted on the shaft 308. A low friction bearing arrangement (e.g. ball bearings 314) provides low friction rotation of the ring 312 on the shaft 308. Again, the pitch sensing device 226" can effectively rotate at the same speed as the pitch sensor tool 216, but in the opposite sense, and thereby remain stationary, or substantially stationary, with respect to the ground.

FIG. 3(*c*) illustrates an alternative embodiment (this is the same as the previous embodiment, except as described hereinafter). The inner compartment of the pitch sensor tool 216 has end walls 316 in addition to the curved walls 302. In this case, the pitch sensing device 226''' (and optionally the battery 230''') are fixedly mounted on an axle 318, the latter being mounted for rotation in conventional low friction bearings 320 embedded in, or fixedly attached to, a respective end wall 316. Thus, the pitch sensing device 226''' (and battery 230''') are free to rotate with respect to the compartment. Again, the pitch sensing device 226''' can effectively rotate at the same speed as the pitch sensor tool 216, but in the opposite sense, and thereby remain stationary, or substantially stationary, with respect to the ground. In this embodiment, this effect is further facilitated by the use of offset weights 332 which act under gravity to maintain the pitch sensing device 226''' stationary while the pitch sensor tool 216 rotates.

In an alternative single stem embodiment, the pitch sensing device may be fixed solid in the pitch sensor tool 216 and rotate with the pitch sensor tool 216.

The invention claimed is:

1. A pitch sensor tool for a dual stem boring or drilling machine, comprising:

a generally cylindrical housing adapted to be coupled to the dual stem of said boring or drilling machine and to a drilling head, the housing comprising an exterior section adapted to be coupled to an outer stem of the dual stem, and an inner section adapted to be coupled to an inner stem of the dual stem, a pitch sensing device, the pitch sensing device being disposed in or on the exterior section and being adapted to transmit a reading of the sensed pitch of the pitch sensor tool, wherein the interior and exterior sections are independent such that, in use, the interior section may rotate while the exterior section remains stationary.

2. The pitch sensor tool of claim 1, wherein the pitch sensing device is fixedly mounted in or on the pitch sensing tool and separated therefrom by a shock absorbing material.

3. The pitch sensor tool of claim 1, wherein pitch sensing device is mounted within a compartment within the pitch sensing tool.

4. The pitch sensor tool of claim 1, wherein the pitch sensing device is mounted in or on the pitch sensing tool at perfect zero percent prior to use, whereby when the pitch sensing tool is in an actual horizontal position, said reading of the sensed pitch transmitted by the pitch sensing device is zero.

5. The pitch sensor tool of any of claim 1, further including a female engagement portion for engagement, in use, by a male engagement portion of the stem.

6. The pitch sensor tool of claim 1, further including a male engagement portion for engagement, in use, by a female engagement portion of the drilling head.

7. The pitch sensor tool of any of claim 1, further including a battery compartment housing a battery for powering the pitch sensing device.

8. A boring or drilling tool, comprising, the pitch sensing tool of one of the preceding claims, and a drilling head, the drilling head including a drill bit.

9. The boring or drilling tool of claim 8, wherein the drilling head includes a housing having a clock sensor mounted therein, the dock sensor being adapted to transmit a reading indicative of the sensed angular position of the drill bit.

10. A stem boring or drilling machine, comprising:

a stem, a drive section for applying rotational energy to the stem, a pitch sensor tool according to claim 1, and a drilling head, the drilling head including a drill bit, wherein the pitch sensor tool is disposed between the stem and the drilling head and mechanically coupled to each.

* * * * *